US005220130A

United States Patent [19]

Walters

[11] Patent Number: 5,220,130

[45] Date of Patent: Jun. 15, 1993

[54] DUAL INSULATED DATA CABLE

[75] Inventor: Jack Walters, Milford, Mass.

[73] Assignee: Cooper Industries, Inc., Houston, Tex.

[21] Appl. No.: 740,792

[22] Filed: Aug. 6, 1991

[51] Int. Cl.[5] ..... H01B 7/34

[52] U.S. Cl. ..... 174/36; 174/113 R; 174/115; 174/116; 174/120 SR

[58] Field of Search ..... 174/36, 115, 113 R, 174/116, 110 FC, 110 F, 120 SR, 120 R

[56] References Cited

U.S. PATENT DOCUMENTS

| | | | |
|---|---|---|---|
| 2,623,093 | 12/1952 | Smith | 174/115 |
| 3,023,267 | 2/1962 | Rubinstein et al. | 174/115 |
| 3,040,278 | 6/1962 | Griemsmann | 174/110 F |
| 3,191,005 | 6/1965 | Cox, II | 174/120 R |
| 3,529,340 | 9/1970 | Polizzano et al. | 174/110 F |
| 3,634,607 | 1/1972 | Coleman | 174/113 R X |
| 3,816,644 | 6/1974 | Giffel et al. | 174/115 |
| 3,867,565 | 2/1975 | Prentice et al. | 174/110 F X |
| 3,986,253 | 10/1976 | Harris | 174/110 F X |
| 4,304,713 | 12/1981 | Perelman | 264/45.9 |
| 4,330,685 | 5/1982 | Bleikamp, Jr. | 174/110 F X |
| 4,532,375 | 7/1985 | Weitzel et al. | 174/110 FC X |
| 4,604,497 | 8/1986 | Bell et al. | 174/110 F |
| 4,638,114 | 1/1987 | Mori | 174/36 |
| 4,701,576 | 10/1987 | Wada et al. | 174/117 F |
| 4,707,569 | 11/1987 | Yoshimura et al. | 174/116 |
| 4,711,811 | 12/1987 | Randa | 174/110 F X |
| 5,059,483 | 10/1991 | Lunk et al. | 174/110 F X |

*Primary Examiner*—Morris H. Nimmo

*Attorney, Agent, or Firm*—Laff, Whitesel, Conte & Saret

[57] ABSTRACT

Existing electrical cables (such as low speed data, low or high speed computer or telephone cables) employ connectors having holes or other openings for receiving the insulation or requiring conductors having a precise pitch. For example, a mechanical part of the connector may close over the received cables, piercing the insulation and making an electrical contact with the conductor inside the insulation. Or, the insulation may also be used to provide the spacing required for mass termination of insulation such as connectors which require a specified pitch. This dimension or pitch is supplied by the inner insulation while the outer insulation supplies the dimension required to meet the impedance/capacitance requirements of the electrical circuits involved. The modern high speed data cables must have substantially more insulation so that the capacitive loading or impedance match of the wire is at an acceptable level. With the increase in insulation, the cable does not fit into the holes or other openings of the existing connectors. The invention solves the resulting problem by providing two coaxial jackets of insulation which meets the high speed data transmission needs or extends the transmission or distance and yet the outer jacket may be stripped away so that the remaining inner jacket fits the existing connectors.

10 Claims, 1 Drawing Sheet

DUAL INSULATED DATA CABLE

This invention relates to insulated electrical cables, and more particularly, cables which are capable of noise free transmission of high speed data.

In the distant past electrical cables and wires merely required insulation which was sufficient to both protect those who might touch the cables and protect the cable against an invasion of its environmental contaminations. For example, the insulation prevented water, oil, acids, or the like from attacking the copper or other material from which the cable is made.

This type of mechanical and electrical shielding was also adequate for protection of the electrical signal until high speed data began to be transmitted over the cable. For example, a person who is simply talking on a telephone probably would not be aware of many noises caused by operation of central office equipment. Or, if he could hear anything, it would be nothing more than something like a faint and inoffensive click. However, with the advent of high speed data transmission between computers and similar machines, the noise resulting from inadequate insulation became intolerable. Therefore, it has become necessary to provide insulation which satisfies not only the mechanical dimension found in the past, but also to improve transmission line parameters for such things as impedance, attenuation, capacitance, improved transmission distances, noise isolation, and the like, when the signals have electronic speed characteristics, as opposed to audio frequency characteristics.

If that need to meet electronic parameters were the only consideration, it would be fairly easy to select an insulation material and design a cable which provides the desired characteristics. However, a difficulty with this simple "select a material" approach is that the cables become too thick to be used with existing connector types. There are so many of these existing connectors already in use that it would be prohibitively expensive to replace them merely to serve the needs of a new type of wire insulation. For example, some connectors have insulation piercing contacts so that it is only necessary to insert an insulated cable into a hole or to lay it in a trough of precise dimensions and then to close a lever or move a tool which pushes a contact through the insulation. Another example would be insulated cables which are simply pushed into an opening which simultaneously cuts through the insulation and makes an electrical connection by seizing the cable without nicking it.

An example of hostile environmental demands upon data transmitting cables would center upon such things as extreme variations in temperature, vibration, and the like. An example of which might be the cable interconnecting the space shuttle engine with its controlling computer. The computer is in a room with very well controlled temperature, probably a human habitat temperature, and the engine which is at a "blow torch" temperature so to speak. There may be a high level of mechanical shock during the flight. Another example of a hostile environment might be the controls for a burner and blower in a pizza oven where the plenum temperature is in the order of 700° F. and the microprocessor for controlling the blower and burner is in, say, a 75° F. room temperature. Other examples could readily come to mind.

Hence, there is a need for a new and better insulated cable which both meets the mechanical dimensions and characteristics of previous wiring and the new and demanding electrical characteristics for high speed data transmission.

Accordingly, an object of this invention is to provide new and improved high speed data cables which meets both the electrical and mechanical needs of a data transmitting system without simultaneously becoming too thick to be useful in existing connectors. In this connection, an object is to provide a cable of the described type which eliminates the need for either adapters or redesigned connectors. Here, an object is to provide high speed data transmission in systems having hardware specifically designed to use with low speed data or telephone cables.

Another object is to provide four or more wire cables which may include both power line cables and signal cables without having the signal cables pick-up the power line hum.

Still another object is to extend the transmission distance of various equipment.

Yet another object is to save space in equipment racks, etc. by avoiding the redesign of connectors to handle the larger diameters of insulation which does not employ stepped insulation.

Still another object of the invention is to provide the described cables which will be at home in many hostile environments.

In keeping with an aspect of the invention, these and other objects are accomplished by providing a dual insulation on the high speed data signal cables. An inner insulation is a jacket which has a diameter which meets the mechanical needs of existing connectors. The outer insulation is a larger diameter jacket which is adequate to meet the electrical needs for high speed electronic data transmission. The inner insulation jacket is preferably made of a relatively tough material which resists mechanical nicking and other injury. The outer insulation jacket is a relatively soft material which may be solid or foamed plastic, which is easily stripped away without damage to the tough inner insulation. The jackets are made of a material taken from a group consisting of polyolefins and fluoropolymers.

The invention also contemplates manufacturing the cable assembly in fixed lengths with the outer insulation extending to within a predetermined distance from the end of a cable so that a short stub section of the inner insulation is exposed to form a cable with stepped insulation (see FIG. 2). For example, if, say, a jumper cord has a two foot length of cable, the completed cable assembly may be cut in two foot lengths, with a half inch of the inner insulation jacket exposed on each end.

A preferred embodiment of the invention is shown in the attached drawings, in which.

Figure 1:
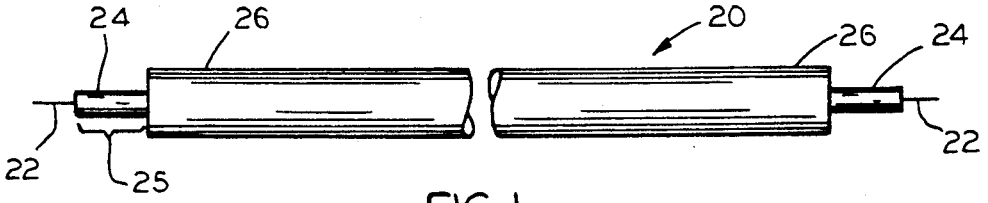
FIG. 1 is a side elevation which shows a single conductor having the dual insulation.

As best seen in FIG. 1 the inventive high speed data transmission signal cable 20 has a conductor 22 covered by an inner insulation jacket 24, and an outer insulation jacket 26. The exposure of conductor 22 may not be present if the cable 20 is used with connectors which make electrical contact by piercing insulation 24. A short stub length 25 of the inner insulation jacket 24 may be manufactured by removing the overlaying outer jacket 26 when the cables are manufactured in discrete lengths.

Figure 3:
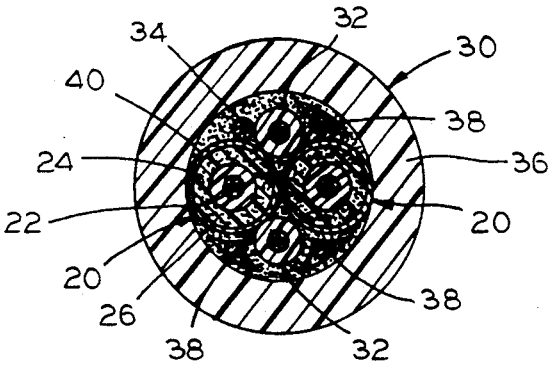
FIG. 3 is an end view of the cable of FIG. 2.
Figure 2:
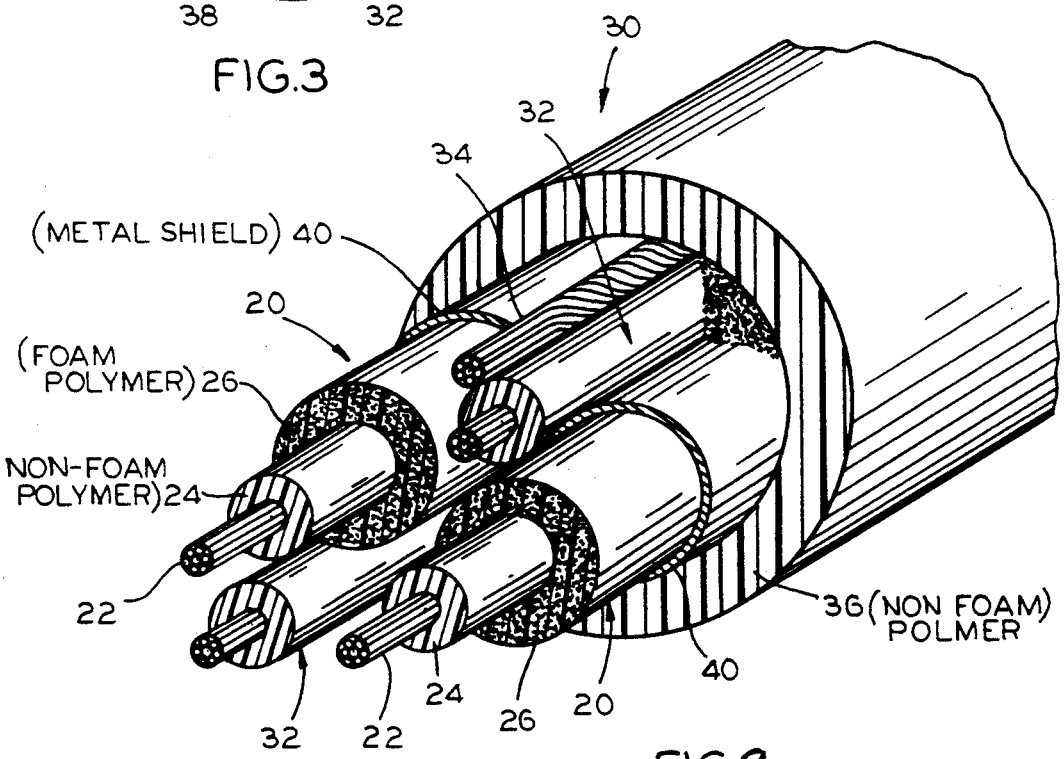
FIG. 2 is a perspective view of a four wire cable with a two wire high speed data cable made of the inventive signal wire, a two wire power line cable, and a common ground.

FIGS. 2 and 3 illustrate an exemplary four wire cable 30 using a pair of the inventive high speed data signal cables 20, two power line cables 32, and a common ground or drain cable 34. The remainder of the cable comprises an outer jacket 36, and a filler 38 of types such as polypropylene, cotton and other material as required. The outer jacket 26 of the high speed data signal cables 20, 20 may be covered by a metal foil and/or braided wire or combination thereof as shielding media 40.

Normally, a power line in such close quarters with a data signal line would likely cause the signal line to pick-up a noise from the power line. However, here, the signal line is further protected by the relatively thick outer jacket layer of insulation 26 and by the shielding media or metal foil 40, 40 surrounding the cables 20. Still, the added bulk of the outer jacket insulation 26 and foil does not prevent a use of existing connectors which may be clipped onto the reduced diameter of the inner jacket insulation 24.

Figure 4:
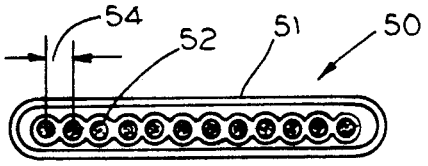
FIG. 4 shows a typical existing connector for flat wire where the pre-existing space requirements must be met by the new cable.

FIG. 4 shows an exemplary connector 50 for a flat cable, which may enjoy the benefits of the invention. Here there is a connector member 51 having twelve holes 52 formed side-by-side in a straight line, with the holes separated from each other by a uniform pitch or distance 54. The cable will be a flat cable having twelve conductors separated by the same pitch or distance 54. Therefore, if a new flat cable is produced, it cannot have wires that are separated by a pitch or distance which is greater than the distance 54. The inner jacket of the present invention satisfies these needs while the outer jacket provides the required insulation and isolation.

While a number of different materials and dimensions may be used, in one exemplary embodiment of the invention (FIG. 2) the inventive high speed data signal cables 20, 20 has a polypropylene inner jacket 24 which also has a wall thickness of 0.006" and an outside diameter of 0.031". The outer jacket 26 is made of foamed polyethylene having a wall thickness of 0.018" and an outside diameter of 0.063". The shielding media or foil 40 is a polyester with a metallic coating, wrapped around the outer jacket with the foil side out. The outside diameter of the foil is 0.068". This particular embodiment uses PVC for the outer jacket, with a wall thickness of 0.025" and an outside diameter of 0.186". The electrical power cables 32, 32 have polypropylene jackets with a wall thickness of 0.006" and an outside diameter of 0.031". Therefore, both the power cable and the high speed data cable may be used with existing connectors.

The electrical characteristics of the inventive wire are matched to the particular equipment to which it is connected. For example, it has been estimated that the maximum capacitance loading in this particular embodiment (FIG. 2) is in the order of 60–70 pf (and specifically is 67 pf) per meter of cable length, the capacitance loading being taken between the high speed data signal cables 22, 22 and between the signal cables and any other cables in the cable.

However, the capacitive loading depends upon many things such as the cable impedance. For example, if the impedance of a 150-ohm wire is reduced to become 100-ohm, its capacitance loading would likely be increased from, say, 8 pf/ft to perhaps become 12 pf/ft. In a high speed data transmission system, the impedance matching becomes very important as compared to the importance of impedance matching in less sophisticated systems. Therefore, beyond this specific example of 67 pf/meter for the exemplary capacitance loading between the signal wires 22, 22 in cable 30, such loading depends, in general, upon much more than merely measuring the insulation characteristic of a particular material and then using enough of it. Thus, merely designating a particular amount of capacitance loading is not really the best way to set forth a parameter for a cable design. Rather, it is better to say that the impedance and capacitance loading of the cable should be matched to the capacitance specified by the equipment connected to it.

In general computer networks which might use the inventive wire have an increased need for a data transmission line made of a foamed insulated cables. One of the better foamed insulation materials which can be used to make outer jacket 26 is a "Teflon" product (fluorocarbon polymer) of E. I. du Pont de Nemours Company. When compared to solid dielectric insulated cables, the Du Pont company describes their product as a foamed material which reduces the dielectric constant and dissipation factor, offers lower capacitance, lowers attenuation, and provides higher velocity of propagation. A low dielectric constant is the main factor in developing low capacitance and high velocity. The low attenuation and low dissipation factor of FEP and PFA results in cables having low signal loss. These characteristics meet the capacitance, velocity, and attenuation requirements of the military specifications, with reasonable foam levels.

The FEP and PFA resins can be made with void contents as high as 70% and dielectric constants as low as 1.3. Comparable cables of polyethylene, foamed to a dielectric constant of 1.5, do not have as low a capacitance or as high a velocity of propagation as does FEP and PFA foam. In addition, structural return loss in FEP and PFA coaxial cables can be controlled within the specifications of MIL-C17.

Cores of FEP foam have approximately twice the compressive strength of similar polyethylene foam cores, measuring the force required to compress the core by 25%. This simulates a situation where mechanical stress might disturb the electrical characteristic of a cable.

The manufacturer describes the properties of several of these foamed "Teflon" products as follows:

| | RG-59 Type Foam Core TEFLON ® FEP | RG-11 Type Foam Core TEFLON ® FEP |
|---|---|---|
| Conductor O.D. | .032 | .064 |
| Core O.D. | .146 | .285 |
| Shield | Foil + 60 Al. | 95% B.C |
| Jacket O.D. | .215 | |
| Weight lbs/1000 ft. | 28[2] | 93 |
| Capacitance, pf/ft. | 16.6 | 16.5 |
| Impedance, ohms | 75 | 75 |
| Attenuation, dB/100 ft. | | |
| 50 MHz | 1.9 | 1.0 |
| 100 MHz | 2.7 | 1.3 |
| 200 MHz | 3.9 | 2.2 |

-continued

| | | |
|---|---|---|
| 300 MHz | 5.0 | 2.9 |
| 400 MHz | 5.8 | 3.4 |
| Velocity of Propagation, % | 82 | 83 |
| Dielectric Constant | 1.48 | 1.45 |

| | Type RG-316 TEFLON ® FEP Foamed Core Coaxial Cable |
|---|---|
| Conductor O.D. | .025 |
| Core O.D. | .060 |
| Capacitance, pf/ft. | 26 |
| Impedance, ohms | 50 |
| Attenuation, dB/100 ft. | |
| 50 MHz | 2.8 |
| 500 MHz | 15 |
| 1.0 GHz | 22 |
| 2.0 GHz | 33 |
| 3.0 GHz | 42 |
| Velocity of Propagation, % | 83.9 |
| Dielectric constant | 1.42 |

The inner jacket 24 of the inventive cable may be made of a "Teflon" fluorocarbon FEP100 made by the Du Pont company which describes it in the following manner.

TEFLON ®FEP 100 fluorocarbon resin is a melt processable copolymer of tetrafluoroethylene and hexafluoropropylene. Its primary uses includes cable and cable primaries and jacketing; round and flat RF transmission lines; electronic hookup cables; chassis to chassis interconnects; computer wirings; industry control cables; downhole cable, coax cable cores, and thermocouple cables.

The Du Pont company supplies the following property data for "Teflon" 100.

| PROPERTY | TEFLON 100 |
|---|---|
| Nominal MFN, 372° C., 5000 gm loaded | 7 |
| Melting Point | 504–540<br>262–282 |
| Specific Gravity | 2.12–2.17 |
| Hardness, Durometer | D55 |
| Tensile Strength 73° F.<br>23° C. | 3000–4000<br>20.7–27.6 |
| Elongation 73° F. (23° C.) | 300 |
| Flexural Modulus 73° F.<br>23° C. | 95.000<br>655 |
| Impact strength 73° F.<br>23° C. | No Break |
| Deformation Underload 73° F., 1000 psi, 24 hr. (23° C., 6.9 N/mm$^2$, 24 h) | 1.8 |
| Continuous Service Temperature | 400<br>204 |
| Thermal Conductivity | 0.25<br>$6 \times 10^{-4}$ |
| Coefficient of Linear Thermal Expansion | |
| per °F. (100° F. to 160° F.) | $4.6–5.8 \times 10^{-5}$ |
| per °C. (38° C. to 71° C.) | $8.3–10.4 \times 10^{-4}$ |
| Dielectric Strength Short time, | |
| 10 mil film | 2100 |
| 0.25 mm | 83 |
| Dielectric Constant 60 to $10^9$ Hz | 2.1 |
| Dissipation Factor 60 to $10^9$ Hz | .0001–.001 |
| Volume Resistivity | $>10^{16}$ |
| Flame rating | AEB 5 mm<br>ATB 5 s |
| Water Absorption | <0.01 |
| Weather and Chemical Resistant | Excellent |

Another example of material which may be used to make the cable jackets 24, 26 is polyethylene DGDA-3485, manufactured by the Union Carbide Corporation, Polyolefins Division. They describe the material as an expandable, high-molecular weight, high-density polyethylene insulation compound specifically formulated for foam/skin telephone singles. The material incorporates a chemical blowing agent which enables the material to attain up to a 50-percent expansion via temperature-controlled extrusion. The material has superior mechanical and electrical properties and has been designed for high speed extrusion. Union Carbide describes their material's properties, as follows:

| PROPERTY | Test Method | Unit | Typical Value |
|---|---|---|---|
| Dielectric Constant, 1 MHz | D 1531 | — | |
| Solid | | | 2.33 |
| Expanded | | | 1.50 |
| Dissipation Factor, 1 MHz | D 1531 | — | |
| Solid | | | 0.0001 |
| Volume Resistivity | REA, PE-200 | ohm-cm<br>Ω · m | $>1 \times 10^{15}$<br>$>1 \times 10^{13}$ |
| Melt Index | D 1238 | g/10 min | 0.9 |
| Density at 23° C. | | | |
| Solid | D 792 | g/cm$^3$ | 0.95 |
| Expanded | | | 0.45 |
| Tensile Strength | D 638 | psi (MPa) | 2,800 (19.3) |
| Elongation | D 638 | % | |
| Solid | | | 500 |
| Expanded | | | 350 |
| Thermal Stress Cracking, $F_0$ | REA, PE-200 | hours | >96 |

Another supplier of suitable insulation material is AUSIMONT, 44 Whippany Road, Morristown, N.J. 07962-1838, which sells HALAR fluoropolymers. The material is described as a melt processable fluoropolymer which possesses a unique combination of properties as a result of its chemical structure—a 1:1 alternating copolymer of ethylene and chlorotrifluoroethylene. It has good electrical properties and a broad use temperature range—from cryogenic to 340° F. (171° C.), and meets the requirements of the UL-94 V-O vertical flame test in thicknesses as low as 7 mils. It is a tough material with excellent impact strength over its broad use temperature range. HALAR ECTFE also maintains its useful properties on exposure to cobalt 60 radiation at dosages of 200 megarads. It is one of the best fluoropolymers for abrasion resistance.

The properties of this material (HALAR 300 and 500 ) are set forth by the manufacturer, as:

| | |
|---|---|
| Mechanical Properties | |
| Tensile strength - at Yield, psi | 4500 |
| at break, psi | 7000 |
| Elongation at break, % | 200 |
| Flexural modulus, psi | 240,000 |
| Impact resistance, ft-lbs/in | |
| Izod, notched, 73° F. (23° C.) | no break |
| −40° F. (−40° C.) | 2–3 |
| Electrical Properties | |
| Dielectric strength, | |
| 0.001 in. thick, V/mil | 2000 |
| ⅛ in. thick, V/mil | 490 |
| Dielectric Constant, at 60 Hz | |
| at $10^3$ Hz | 2.5 |
| at $10^6$ Hz 2.6 | 2.5 |
| Dissipation factor, at 60 Hz | <0.0009 |
| at $10^3$ Hz | 0.005 |
| at $10^6$ Hz | 0.003 |
| Chemical Resistance, 212° F. (100° C.) | |
| Sulfuric acid, 60°Be | no attack |
| 98% | no attack |

-continued

| | |
|---|---|
| Nitric acid, concentrated | no attack |
| Aqua regia | no attack |
| Sodium hydroxide, 50% | no attack |
| Flammability | |
| Oxygen index, 1/16" | 60 |
| UL 94 vertical, 0.007" | 94 V-O |
| Flame Spread & Smoke Generation | |
| Up to 200 Pair Cable | Pass |
| Thermal Properties | |
| Melting Point | 240° C. (464° F.) |
| Brittleness temperature | <−76° C. (−105° F.) |
| Maximum service temperature | 150–170° C. (300–340° F.) |
| Heat distortion temperature under load (ASTM-D-648) | |
| 66 psi stress | 115° C. (240° F.) |
| 264 psi stress | 76° C. (170° F.) |
| Processing | |
| Stock temperature | 500–540° F. (260°–280° C.) |
| Mold (linear) shrinkage, in/in | 0.02–0.025 |

AUSIMONT recommends this product for wire and cable insulation and jacketing; plenum cable insulation and jacketing; foamed insulation in coaxial cable constructions; hookup and other computer wire insulation; oil-well wire and cable insulation, logging wire jacketing and jacketing for cathodic protection; aircraft, mass transit and automotive wire; equipment in contact with corrosive media; switch plates and gears; connectors; coil forms; terminals, resistor sleeves; wire tie wraps; potentiometer slider assemblies; tapes; tubing; parts with metal inserts; battery cases; fuel-cell membranes; flexible printed circuitry and flat cable.

Those who are skilled in the art will readily perceive how to modify the invention. Therefore, the appended claims are to be construed to cover all equivalent structures which fall within the true scope and spirit of the invention.

I claim:

1. An electrical signal cable for use in a system for transmitting high speed data over low speed data or telephone lines, said low speed data or telephone lines having a plurality of existing connectors which make electrical contact by piercing an insulating jacket on said low speed or telephone lines, comprising an insulating polymer signal cable outer jacket, said signal cable outer jacket surrounding at least two high speed data cables and at least two power line cables and at least one ground able, each of said high speed data cables having a central conductor, an insulating non-foam polymer high speed signal jacket surrounding said central conductor, an insulating foam polymer high speed signal jacket surrounding said non-foam polymer high speed signal jacket and a metal shield means surrounding said foam polymer high speed signal jacket, said foam polymer high speed signal jacket having a larger thickness than said non-foam polymer high speed signal jacket and wherein said foam and non-foam insulation being an adequate insulation to reduce a capacitance loading between said power cables and said high speed data cables with reduction of noise being to levels which are below a level necessary for high speed data transmission, each of said power line cables having a central power line conductor and an insulating non-foam polymer power line jacket surrounding said power line conductor; and at least one end of said signal cable having a portion of said high speed data cables and said power line cables extending beyond said signal cable outer jacket, and said high speed data cables having a stepped insulation end with said non-foam insulation high speed jacket extending beyond said foam insulation high speed jacket.

2. The signal cable of claim 1 wherein said non-foam polymer high speed jacket is sized to mechanically fit said existing connectors.

3. The cable of claim 2 wherein said non-foam high speed signal jacket is a tough nick resistance material and said foam jacket is a soft material which is easily stripped away from said non-foam high speed signal jacket.

4. The signal cable of claim 1 wherein said non-foam high speed jacket is made of a tough nick resistant material and said foam high speed jacket is made of a foam material which is easily stripped away from said inner jacket.

5. The signal cable of claim 1 wherein said non-foam high speed jacket is a fluorocarbon polymer and said foam high speed jacket is a foamed fluorocarbon polymer.

6. The signal cable of claim 4 wherein said non-foam high speed jacket is polypropylene and said foam high speed jacket is foamed polypropylene.

7. The signal cable of claim 1 wherein each of said jackets are made of a material taken from a group consisting of polyolefins and fluoropolymers.

8. The signal cable of claim 1 wherein said high speed data signal cable is manufactured in discrete lengths with a short stub of said non-foam high speed jacket being exposed at each end of said discrete length of cable.

9. A cable for use in a system for transmitting high speed data over low speed data or telephone lines, said low speed data or telephone lines having existing connectors which make electrical contact by piercing an insulating jacket on said low speed or telephone cables, said cable comprising:

a common ground;

at least one pair of power cables;

at least one pair of high speed data signal cables, each of said high speed data signal cables having a conductor that is covered by an inner insulation jacket and an outer insulation jacket, said inner insulation is sized to mechanically fit said existing conductors and said outer insulation jacket reducing capacitive loading between said power cables and said high speed data signal cables to levels which do not interfere with said high speed data transmission, wherein said outer insulation jacket extends within a predetermined distance from one end of each of said high speed data signal cables for exposing a short stub section of said inner insulation jacket so that each of said high speed data signal cables has a stepped insulation at said one end, said inner insulation jacket is a fluorocarbon polymer, said outer insulation jacket is a foamed fluorocarbon polymer, said outer insulation jacket being covered by a shielding media;

said power cables being separated from each other by said high speed data signal cables;

an outer cable jacket that encases said common ground, said at least one pair of power cables and said at least one pair of high speed data signal cables; and a polypropylene filler that is also encased by said outer cable jacket and which fills the interstices between said common ground, said at least one pair of power cables and said at least one pair of high speed data signal cables.

10. The cable of claim 9 wherein said shielding media is metal and covers said foam jacket of said high speed data signal cables to provide electrical shielding therefor.

* * * * *